US010448688B2

(12) United States Patent
Cassell et al.

(10) Patent No.: US 10,448,688 B2
(45) Date of Patent: Oct. 22, 2019

(54) APPARATUS TO PREVENT REMOVAL OF AN ARTICLE OF CLOTHING BY A YOUNG CHILD

(71) Applicants: Dana Cassell, Woodcliff Lake, NJ (US); Haryce Cassell, Woodcliff Lake, NJ (US)

(72) Inventors: Dana Cassell, Woodcliff Lake, NJ (US); Haryce Cassell, Woodcliff Lake, NJ (US)

(73) Assignee: HDLJ Creations LLC., Woodcliff, NJ (US)

( * ) Notice: Subject to any disclaimer, the term of this patent is extended or adjusted under 35 U.S.C. 154(b) by 0 days.

(21) Appl. No.: 16/001,256

(22) Filed: Jun. 6, 2018

(65) Prior Publication Data

US 2018/0279706 A1 Oct. 4, 2018

Related U.S. Application Data

(63) Continuation-in-part of application No. 15/144,912, filed on May 3, 2016, now Pat. No. 10,117,475.

(60) Provisional application No. 62/158,292, filed on May 7, 2015.

(51) Int. Cl.

| | |
|---|---|
| ***A41F 13/00*** | (2006.01) |
| ***A43C 19/00*** | (2006.01) |
| *A41B 11/00* | (2006.01) |

(52) U.S. Cl.

CPC ..... *A41F 13/00* (2013.01); *A43C 19/00* (2013.01); *A41B 11/002* (2013.01)

(58) Field of Classification Search

CPC ..... A41F 13/00; A41F 11/02; A43B 23/0245; A43B 23/28; A43B 3/30; A43C 19/00; A41B 11/12; A41B 11/123; A41B 11/00; A41B 11/002; A44B 11/08

USPC ..... 2/240, 313–318, 321, 322, 239

See application file for complete search history.

(56) References Cited

U.S. PATENT DOCUMENTS

| | | | | |
|---|---|---|---|---|
| 271,891 | A | 2/1883 | McDermott | |
| 615,271 | A | 12/1898 | Hayden et al. | |
| 1,189,665 | A | 7/1916 | Clear et al. | |
| 1,256,444 | A | 2/1918 | Derritt | |
| 1,359,672 | A * | 11/1920 | Cavalier | A41F 11/02 2/306 |
| 1,361,565 | A | 12/1920 | Christy | |
| 2,238,804 | A | 4/1941 | Brown | |

(Continued)

FOREIGN PATENT DOCUMENTS

| | | |
|---|---|---|
| CN | 101982129 | 3/2011 |
| CN | 202566313 | 12/2012 |
| WO | 2001065959 | 9/2001 |

OTHER PUBLICATIONS

PCT/US2016/030513; International Search Report & Written Opinion; dated Jul. 27, 2016.

*Primary Examiner* — Jack W Lavinder

(74) *Attorney, Agent, or Firm* — Gearhart Law, LLC.

(57) ABSTRACT

A loss prevention mechanism may be attached to an article of clothing to prevent the removal of the article and/or at least one covering worn by the child. The covering(s) may be any number of type of covering including socks, shoes, gloves, mittens, hats, and the like. The coupling mechanism is easy to operate yet requires a combination of skills not often exhibited by young children. Further, the components are all interconnected thereby preventing separation of and choking on any of the components.

12 Claims, 17 Drawing Sheets

(56) References Cited

U.S. PATENT DOCUMENTS

| | | | |
|---|---|---|---|
| 3,938,264 | A | 2/1976 | Burrell |
| 4,169,324 | A | 10/1979 | Gibbs |
| 4,187,619 | A | 2/1980 | Gibbs |
| 4,744,333 | A | 5/1988 | Taylor |
| 5,499,459 | A | 3/1996 | Tomaro |
| 6,247,183 | B1 | 6/2001 | Haas-Laursen |
| 6,393,619 | B1 | 5/2002 | Bardes |
| 6,775,849 | B1 | 8/2004 | Messman |
| 7,434,336 | B2 | 10/2008 | Kosted |
| 7,849,523 | B2 | 12/2010 | Crittenden et al. |
| 2005/0011083 | A1 | 1/2005 | Kosted |
| 2006/0248748 | A1 | 11/2006 | Warren |
| 2007/0074429 | A1 | 4/2007 | Mckay |
| 2008/0034478 | A1 | 2/2008 | Patterson |
| 2011/0011902 | A1 | 1/2011 | Eem |
| 2013/0091731 | A1 | 4/2013 | Wang |
| 2013/0269218 | A1 | 10/2013 | Blumenaus |
| 2014/0041099 | A1 | 2/2014 | Boyd et al. |
| 2014/0173804 | A1 | 6/2014 | Matos |

* cited by examiner

APPARATUS TO PREVENT REMOVAL OF AN ARTICLE OF CLOTHING BY A YOUNG CHILD

CLAIM OF PRIORITY

This application claims priority to U.S. application Ser. No. 15/144,912 filed on May 3, 2016 which claims priority to U.S. Ser. No. 62/158,292 filed on May 7, 2015, the contents of both of which are fully incorporated herein by reference in its entirety.

FIELD OF THE EMBODIMENTS

The field of the embodiments of the present invention relates to an apparatus for preventing the removal of a covering from a body, namely preventing the removal of an article of clothing and/or footwear from an appendage. In particular, the embodiments pertain to a strap fastening connection mechanism that may be employed to prevent young children from dislodging or otherwise removing and causing loss of an article of clothing and/or footwear.

BACKGROUND OF THE EMBODIMENTS

It is of vital importance that young children, especially infants and babies, wear assorted coverings such as gloves, mittens, socks, shoes, hats, and the like on various bodily appendages. Such coverings can protect the child from the environment and help maintain normothermia. However, these coverings can be lost in a number of fashions as a child squirms, kicks, or otherwise moves about.

As a baby ages they begin to become more aware of the surroundings. This typically leads to a baby playing with the hands and feet often times pulling and grabbing at individual fingers and toes. As the baby's motor skills increase, they become more adept at removing these various coverings by their own deliberate actions, however, they lack the skills to put them back on or prevent their loss. In many instances, for example a shoe, may become lost without the parent or caregiver realizing the loss until it is too late. This, as noted, is not only undesirable for the child but can also impart monetary hardships on a new parent as these various coverings can be expensive to replace.

Additionally, it is important that any such implementation be safe for use. Young children, as noted, are particularly inquisitive about their surroundings. As they "discover" new senses, abilities, and the like, the likelihood of injury becomes greater. Young children, especially babies, can be quite adept at biting or otherwise separating parts from toys, clothing, etc. In fact, federal law dictates that warnings pertaining to choking hazards must be placed on such products. Thus, it is of great importance that any system designed for children be devoid of small parts or parts that may be separated from larger parts that could result in choking and/or serious injury to a child.

There have been attempts to rectify this potential loss of clothing items but have been met with tepid results as they can be difficult to implement and may be uncomfortable for the baby. These solutions may involve using cords, wraps, straps, and the like to secure a covering to another article of clothing or to the baby itself. A more prudent solution takes advantage of a baby's natural inability to interact with their surroundings on a grander scale. Typically children three years of age or less have many individual skills, but may not have the capability to combine skills to solve a problem.

Thus, while a child may have great manual dexterity, finger strength, and problem-solving skills, these are often exhibited in a disjointed manner.

The present invention and its embodiments provides for an apparatus that can be used to couple a covering such as a shoe and sock combination to one another to prevent removal of both covering items. The simple, yet innovate apparatus, is easily manipulated by adults, however, cannot be operated by young children. The apparatus, in one embodiment, prevents the shoe from being removed over the heel thereby preventing removal of the shoe. Clearly, a sock cannot be removed without first having removed the shoe. Further, the apparatus is intended to be of a unitary construction thereby preventing choking or other harm from befalling a child. Review of related technology:

U.S. Pat. No. 6,393,619 pertains to an anklet that includes a strap that encircles an ankle of a child, a quick disconnect buckle that is affixed to, and selectively maintains, the strap around the ankle, and a leash that depends from the strap and engages a foot covering worn by the child so as to prevent loss of the foot covering if unintentionally removed. The strap includes an ankle-facing layer that is made of an elastomer with a modulus of elasticity, and an ambient-facing layer that directly overlies the ankle-facing layer and is made of a fabric that has a limited modulus of elasticity so as to prevent the ankle-facing layer from passing the modulus of elasticity thereof and failing. The leash is an endless loop that extends through the foot covering and then extends back through itself, and in so doing, becomes self-fastened to the foot covering.

U.S. Pat. No. 4,187,619 pertains to a connector which can be detachably fastened at one end to the rear of a sock at or above the heel region and which can be detachably fastened at the other end to the outside of the rear or heel region of a shoe. This connector, when fastened, completely restrains riding or sliding of the sock into the shoe.

U.S. Pat. No. 4,169,324 pertains to a sock having a flap protruding from its rear or heel area, which flap can be fastened to the outside of the rear or heel area of a shoe to prevent the sock from riding, slipping or otherwise working into the heel cavity of the shoe as the person wearing the sock and shoe moves about.

U.S. Application 2011/0011902 pertains to a baby sling with foot support shoes, which is capable of supporting a baby's feet so that the baby's knees are bent and legs are not dangling when the baby is held on a holder's chest by the baby sling, so as to prevent the baby's thighs from being pressed and chafed between the holder and the baby sling, while improving the baby's health and stability by allowing smooth blood circulation.

Thus, various devices are known in the art. However, their structure and means of operation are substantially different from the present disclosure. The other inventions fail to solve all the problems taught by the present disclosure. The present invention provides for an apparatus that may be used with various articles of clothing to prevent their separation. The apparatus can be easily manipulated by adults, while preventing children from completing the same task. At least one embodiment of this invention is presented in the drawings below and will be described in more detail herein.

SUMMARY OF THE EMBODIMENTS

The present invention and its embodiments generally describe an apparatus that can be used to couple more than one article of clothing and/or footwear to another. This is achieved via a multi-layer system that employs various combinations of motor skills to operate. Such skills are present in children, teens, and adults but not easily operated by young children. In a preferred embodiment, the present invention comprises a sock that is capable of interacting with an article of footwear wherein the footwear is coupled to the sock thereby preventing removal of the article of footwear. In other instances, when the article of footwear is not used the sock, in accordance with the present invention, further prevent removal of the sock itself. However, the same principles described herein may be equally applicable to mittens, hats, gloves, and the like or any combination thereof.

In one embodiment of the present invention there is an apparatus to prevent the removal of at least one covering, the apparatus having a first connector coupled to a first covering, the first connector having a connector capable of forming a connection with a second covering, and a second connector coupled to the first connector and the first covering, wherein the second covering is positioned in a proximity to the first covering.

In another embodiment of the present invention there is an apparatus to prevent the removal of at least one covering, the apparatus having a first connector coupled to a first covering, the first connector having a connector capable of forming a connection with a second covering, wherein a channel covering is disposed on a surface of the first covering; a second connector coupled to the first connector and the first covering, the second connector having a first section and a second section; and wherein the second covering is at least partially disposed over the first covering, wherein the connector has a first coupling channel and a second coupling, the first coupling channel capable of removably coupling to the second covering.

In yet another embodiment of the present invention there is an apparatus to prevent the removal of at least one covering, the apparatus having a first strap connector coupled to a first covering, the first strap connector having a first end and a second end with a hinged connector disposed on the first end and being capable of forming a connection with a second covering, wherein a channel covering is disposed on a surface of the first covering, and wherein the hinged connector has a first coupling channel and a second coupling channel, the first coupling channel being capable of hingeably coupling to the second covering; and a second strap connector coupled to the second end of the first strap connector and the first covering, the second strap connector having a first strap section and a second strap section and at least one coupling mechanism and at least one complementary coupling mechanism, wherein the second strap connector passes through the channel covering and the at least one coupling mechanism is coupled to the at least one complimentary coupling mechanism.

In another aspect of the invention there is a method of retaining at least one covering to prevent removal and/or loss of the at least one covering, the method comprising the steps of: providing a first covering having a first connector disposed thereon, the first connector having a connector coupled thereto; coupling a first end of a second connector to a second end of the second connector, wherein the second connector is positioned around and coupled to the first covering; providing a second covering in a proximity to the first covering; and coupling the connector of the first covering to the second covering thereby securing the first covering to the second covering.

In at least one embodiment, there is a sock and an article of footwear capable of being coupled to one another to prevent removal of both covering items. In the preferred embodiment, there is a channel cover disposed on a surface of the sock. This channel cover provides for an opening at each end of the channel formed between the channel cover and the sock. A strap or securement strap passes through this channel. Each end of the strap has a connection mechanism disposed thereon. On an opposing side of the sock, the strap passes through a second channel member of the first connector and may further be secured by a second strap. The ends of the strap are then brought together and coupled thereby securing the sock to the foot of the young child.

A connector coupled to the sock passes through an aperture in the cuff of the sock. The cuff is folded down and secured by the passing of this connector through the aperture. This prevents access to the channel formed by the connector, as the sock cuff has been folded down thereover and secured in position. The connector is then used to couple a heel loop or other comparable structure of the article of footwear to the sock. The set-up is now complete and a parent or caregiver can feel confident that neither the sock nor the footwear will become separated from one another.

In yet another embodiment of the present invention there is an apparatus for preventing removal of an article of footwear, the apparatus being a sock with a first strap coupled thereto, the first strap having a first end and a second end, wherein the first end has a first connector disposed thereon and the second end has a second connector disposed thereon; a second strap coupled to the first strap, the second strap being configured to form at least one channel; and a third strap configured to pass through the at least one channel, wherein the third strap has a third connector disposed thereon.

In yet another embodiment of the present invention there is an apparatus for preventing removal of an article of footwear, the apparatus being a sock having a first strap coupled thereto, the first strap having a first end and a second end, wherein the first end has a male connector disposed thereon and the second end has a female connector disposed thereon; a second strap directly affixed to the first strap, the second strap being configured to form at least one channel and having a male connector disposed thereon; and a third strap configured to pass through the at least one channel, wherein the third strap has a female connector disposed on a first end of the third strap, and wherein a length of the third strap is adjustable.

In yet another aspect of the present invention there is a method of securing of an article of footwear, the method comprising the steps of: providing a sock having a first strap coupled thereto, the first strap having a first end and a second end, wherein the first end has a first connector disposed thereon and the second end has a second connector disposed thereon; a second strap coupled to the first strap, the second strap being configured to form at least one channel; and a third strap configured to pass through the at least one channel, wherein the third strap has a third connector disposed thereon; wrapping the third strap around a circumference of the sock, wherein the third strap passes through a channel of the article of footwear; coupling the third connector to a fourth connector disposed on the second strap; coupling the second connector of the first strap to the first connector of the first strap.

Further, the system is designed and intended to be safe for use by children, especially young children. Every component is intended to be adhered to one another in a way that prevents separation of any one component from another. Not only does this create an effective set up for preventing the removal of an article but also serves to prevent any component or the invention as a whole from becoming a choking hazard to the young child.

In general, the present invention succeeds in conferring the following, and others not mentioned, benefits and objectives.

It is an object of the present invention to provide an apparatus that couples one covering item to another covering item.

It is an object of the present invention to provide an apparatus that is safe for use by young children.

It is an object of the present invention to provide an apparatus that is comprised of various interconnected components giving rise to a solitary construction.

It is an object of the present invention to provide an apparatus that prevents removal and/or loss of an article of footwear.

It is an object of the present invention to provide an apparatus that is easily manipulated by adults but cannot be operated by young children.

It is an object of the present invention to provide an apparatus that has multiple levels of securement preventing removal of any of the components.

It is an object of the present invention to provide an apparatus that is lightweight and comfortable to wear.

It is an object of the present invention to provide an apparatus that is non-intrusive.

It is an object of the present invention to provide an apparatus that saves a consumer money by preventing and/or limiting the loss of certain items.

It is an object of the present invention to provide an apparatus that can accommodate children of various shapes and sizes.

It is an object of the present invention to provide an apparatus that can be used with multiple styles and types of coverings including socks, footwear, mittens, gloves, hats, and the like.

It is an object of the present invention to provide an apparatus that is discreet.

It is an object of the present invention to provide an apparatus that saves time in putting footwear on a child.

It is an object of the present invention to provide an apparatus that prevents feet and associated skin surfaces from being exposed to the elements.

DESCRIPTION OF THE PREFERRED EMBODIMENTS

Figure 1:
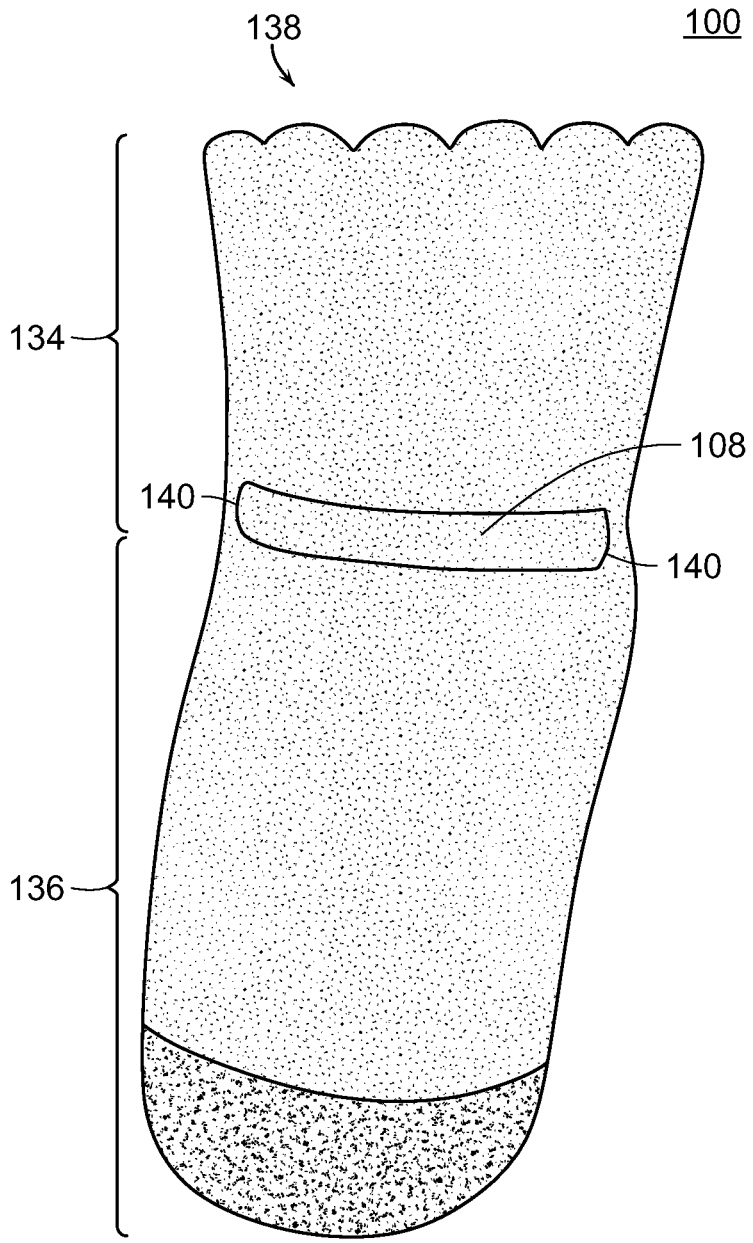
FIG. 1 is a perspective view of the first covering with the channel exposed.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, there is a first covering 100 depicted as a sock. The first covering 100, however, may be virtually any type of covering including but not limited to a hat, glove, mittens, stockings, and the like or non-clothing items or any combination thereof.

The first covering 100 generally has a first or top area 134 and a second or bottom area 136. These may or may not be a physical top or bottom and may just refer to the relationship of one section to the other section. A channel covering 108 is located approximately where the top area 134 ends and the bottom area 136 begins. However, in other embodiments alternate positions of the channel covering 108 may be available. The channel covering 108 may be a strip of material that is the same or different from the material comprising the first covering 100. The channel covering 108 is preferably adhered to the covering 100 along at least one point along the channel covering 108. The channel covering 108 preferably defines a channel having channel openings 140 which enable a material to be passed between the channel covering 108 and the first covering 100 and secured or otherwise held therein. In order to allow the first covering 100 to be positioned over an object there is at least one opening 138 disposed on the first covering 100.

Figure 2:
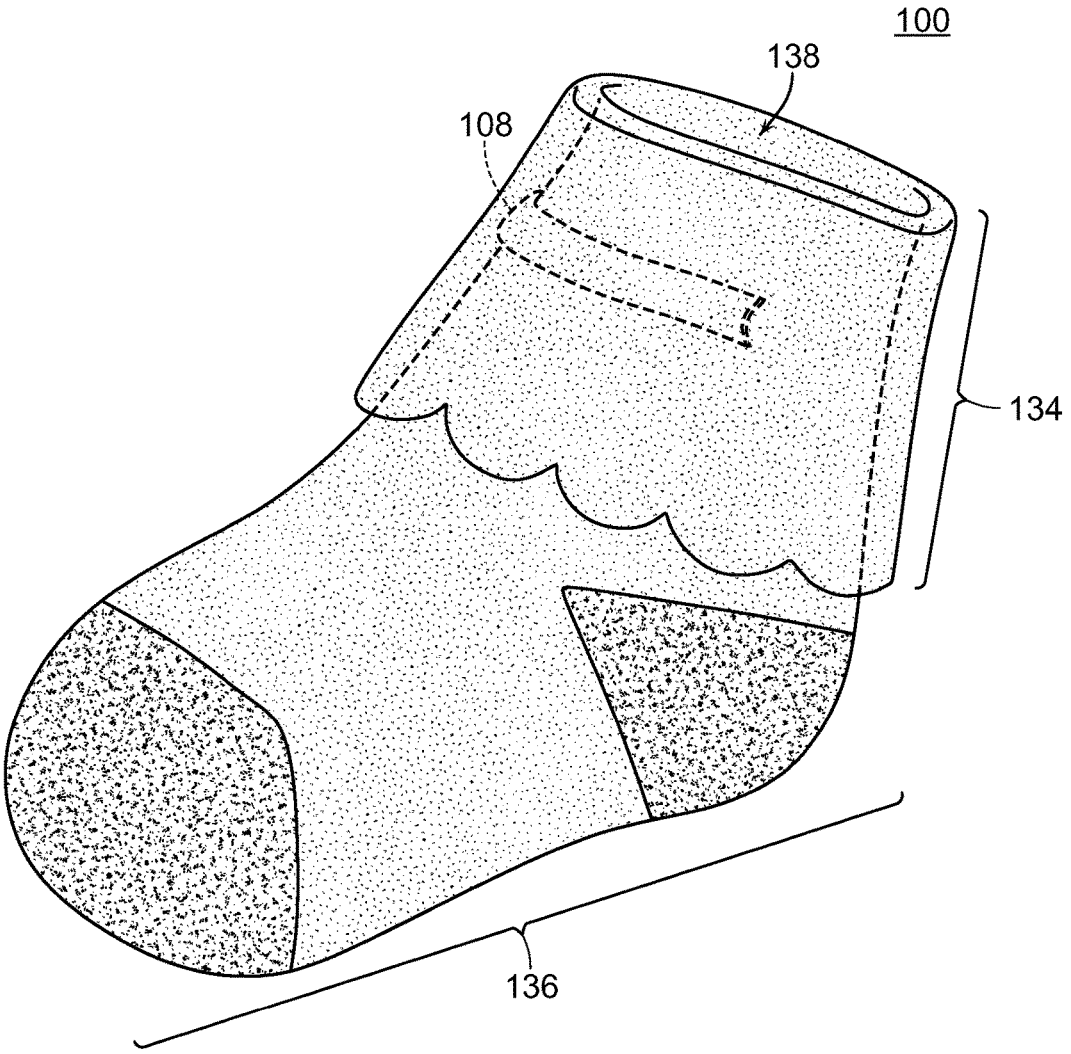
FIG. 2 is a perspective view of the first covering with a top folded down covering the channel.

In FIG. 2, the first covering 100 is shown with the top area 134 folded down covering a portion of the first covering 100. The uncovered portion may comprise only the bottom area 136 or a combination of the top area 134 and the bottom area 136. As shown, it is preferable to have the channel covering 108 covered by the top area 134 once folded and positioned as shown. In other embodiments this channel covering 108 may remain exposed.

Figure 3:
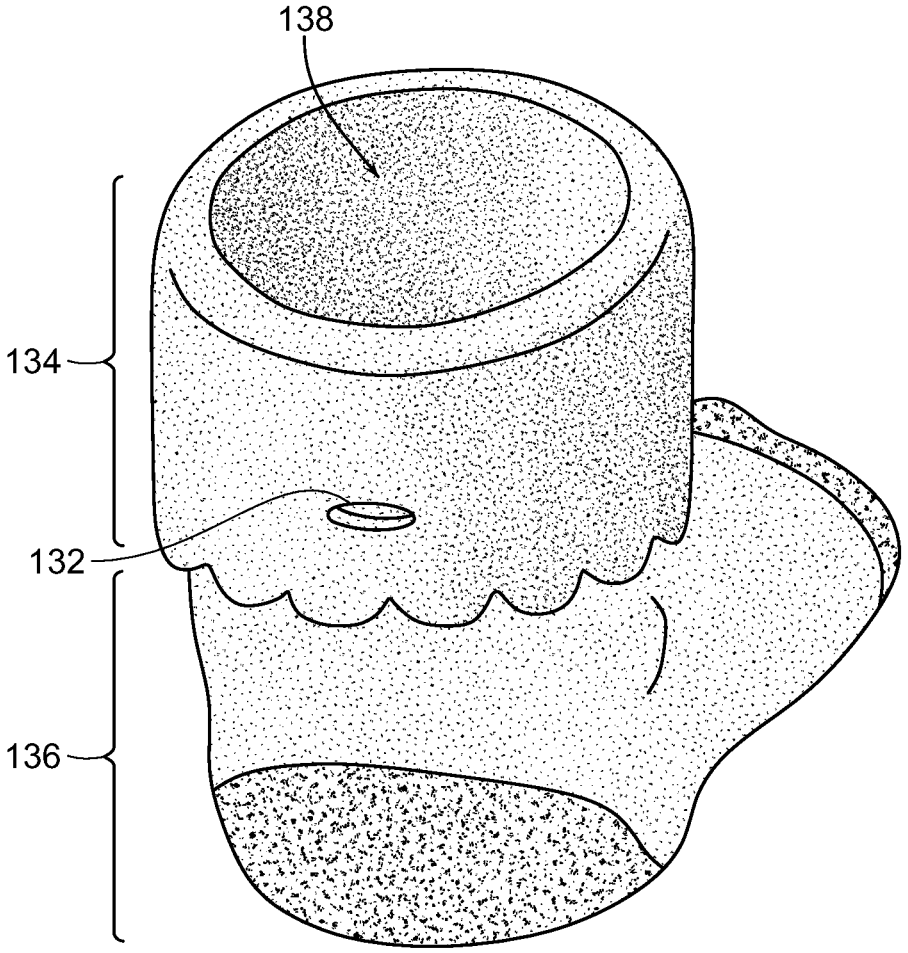
FIG. 3 is a back view of the first covering with the top folded down.

From the back of the first covering 100, as shown in FIG. 3, there is an aperture 132 residing in the top area 134. The aperture 132 may be aligned with a second aperture (not shown) in another section of the first covering 100. The aperture 132 may be oriented in a number of fashions including vertical, horizontal, diagonal, or the like. The aperture 132 may also be located in other positions besides the back of the covering including but not limited to the front, sides, bottom, top, or the like or some combination thereof. Further, in FIG. 3, the bottom area 136 and the opening 138 are also shown.

Figure 4A:
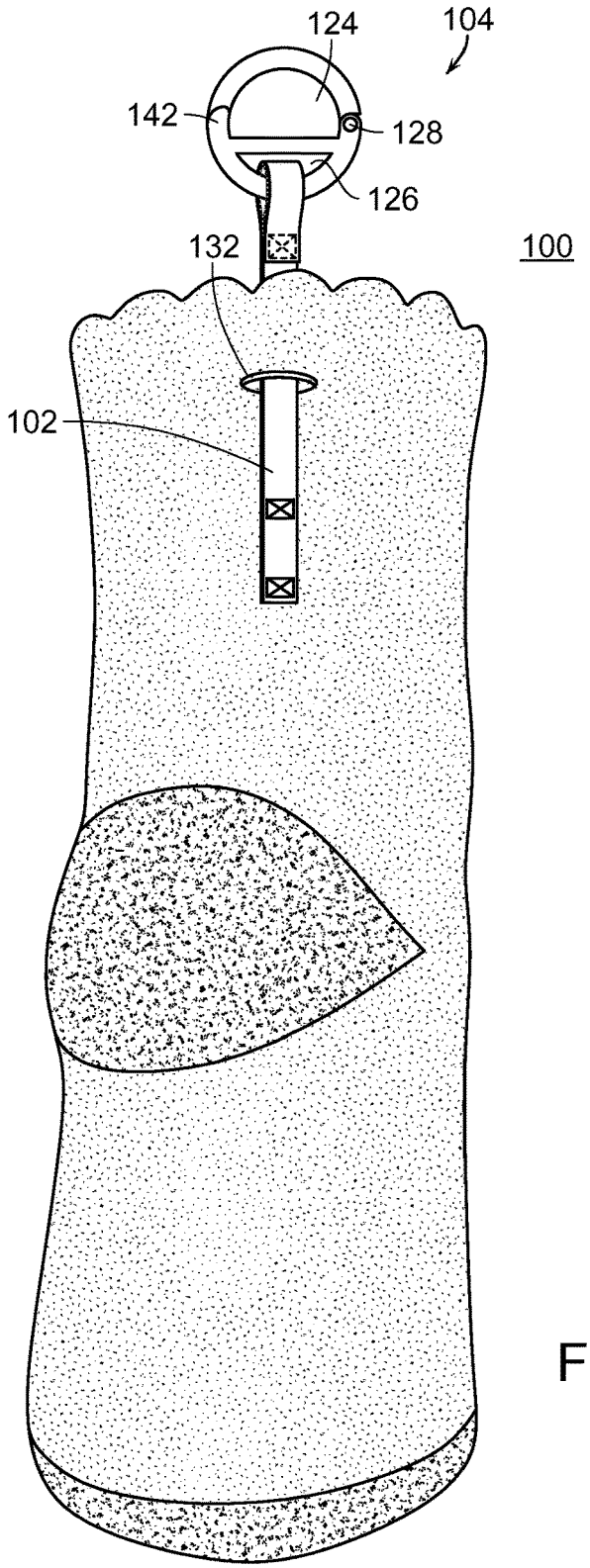
FIG. 4A is a back perspective view of the first covering with the top extended and the first connector coupled thereto.

In FIG. 4A, the first connector 102 is shown coupled to the first covering 100. At an end of the first connector 102 there is a connector 104. The first connector 102 preferably passes through the aperture 132 where it terminates with the connector 104. The connector 104 preferably has at least a first coupling channel 124 and a second coupling channel 126. The connector 104 may further have a securement mechanism 142 to secure the position of at least one of the coupling channels and a hinge 128 or other comparable mechanism to allow movement of at least one of the coupling channels and in some cases movement of at least one of the coupling channels respective to one another.

Figure 4B:
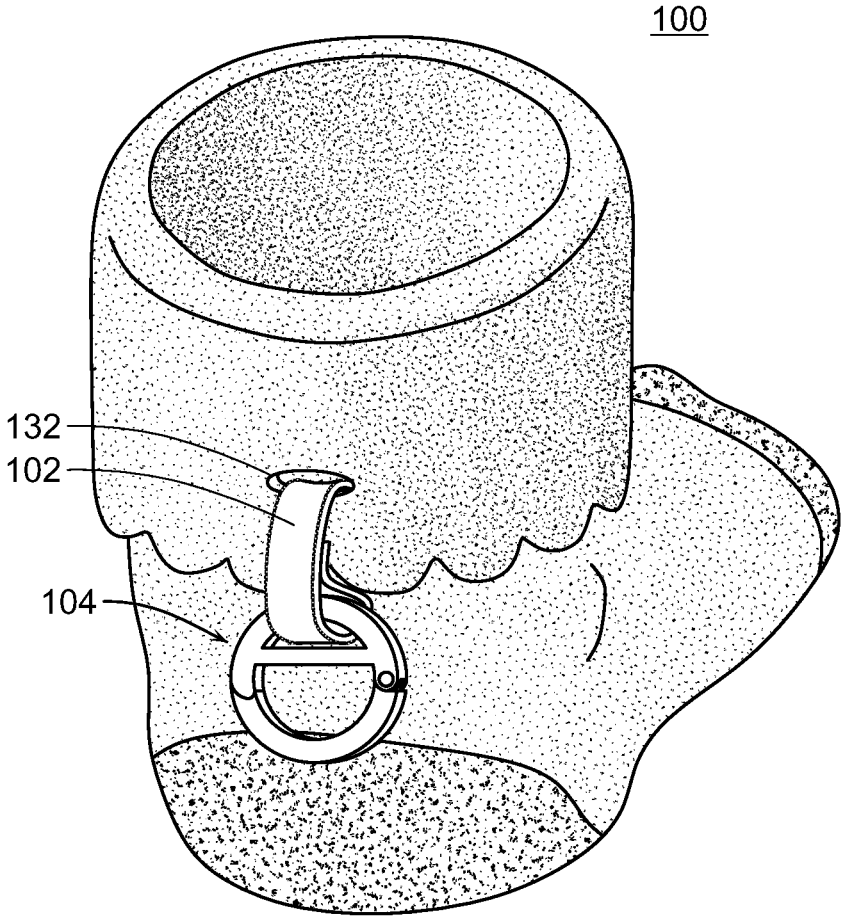
FIG. 4B is a back perspective view of the first covering with the top folded down and the first connector coupled thereto.

The top area 134 of the first covering 100 has been folded down, in FIG. 4B, in accordance with the previous description herein. The first connector 102 has been positioned to pass through the aperture 132. The connector 104 is then allowed or positioned to hang in a downward position from the aperture 132.

Figure 5A:
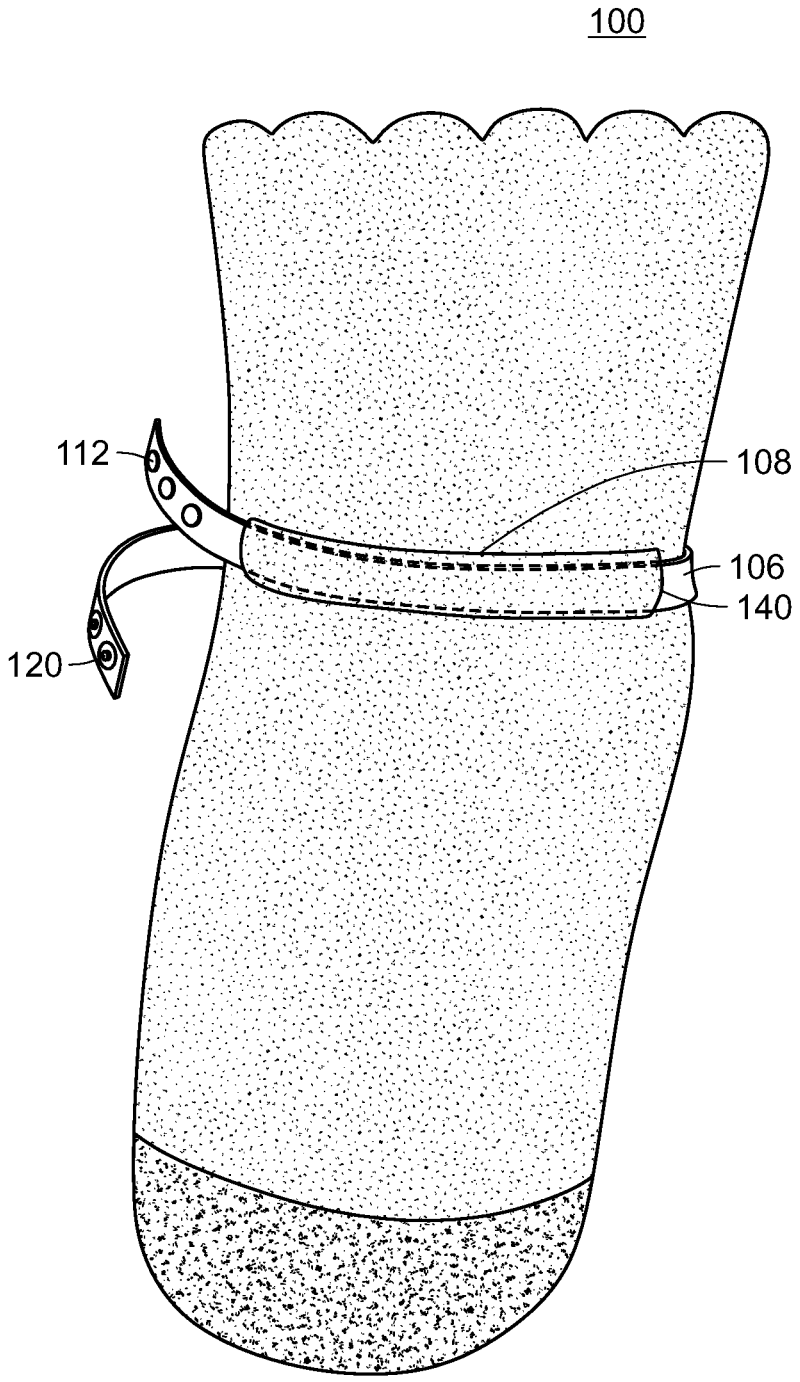
FIG. 5A is a front view of the first covering with the second connector passing through the channel.

Referring now to FIG. 5A, the first covering 100 is shown with a second connector 106 passing between the channel covering 108 and the first covering 100. The second connector 106 passes through the channel covering 108 via the channel openings 140. The second connector 106 has a first end and a second end with at least one coupling mechanism 112 disposed on one end and at least one complementary coupling mechanism 120 disposed on the other end. The complementary coupling mechanism(s) 120 is capable of being coupled to the coupling mechanism(s) 112. The coupling mechanisms 112 and complimentary coupling mechanisms 120 may be any number of mechanisms including but not limited to hook and loop fasteners, clasps, snaps, buttons, clips, and the like or any combination thereof.

Figure 5B:
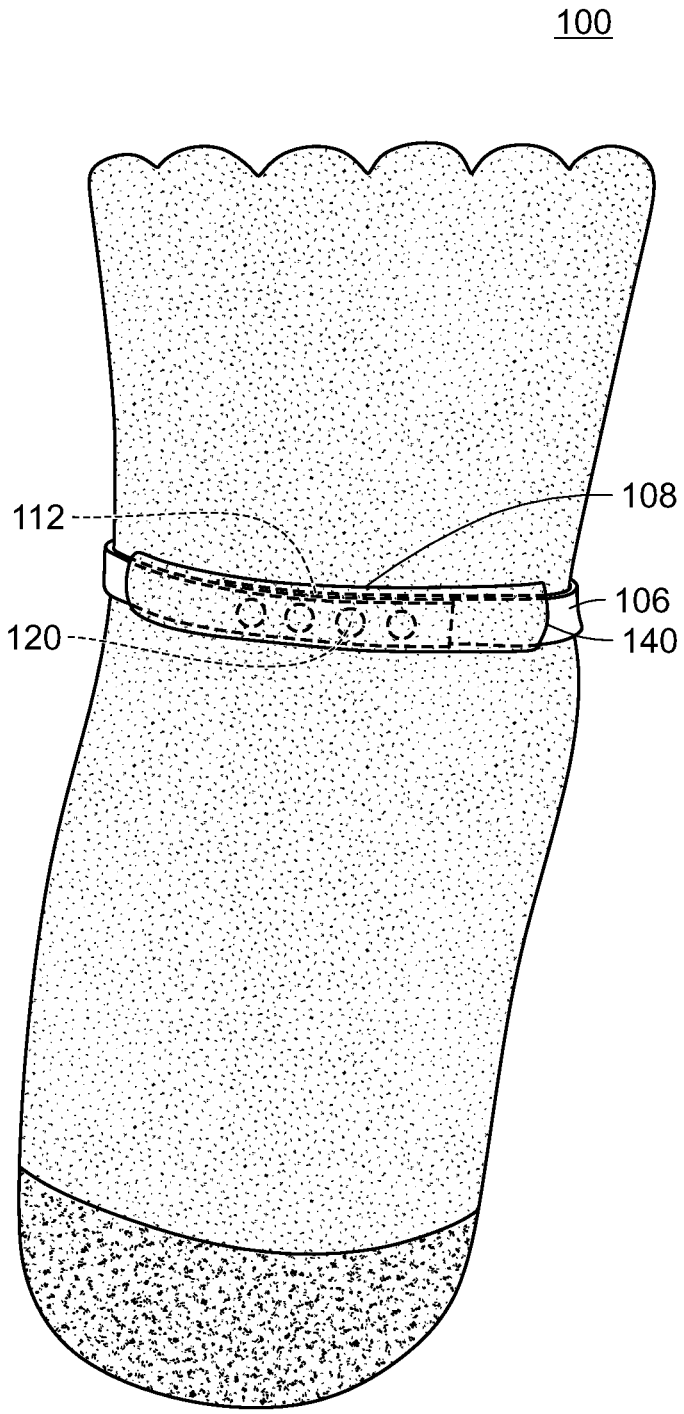
FIG. 5B is a front view of the first covering with the second connector coupled thereto.

In FIG. 5B, the two ends of the second connector 106 have been coupled via the coupling mechanisms 112 and complimentary coupling mechanisms 120 as described. The second connector 106 can then be positioned (see FIG. 6) in order to have the two secured ends positioned of the second connector under the channel covering 108. When this is accomplished, one can fold down the top area as shown in FIG. 4B thereby covering the channel covering 108 and second connector 106.

Figure 6:
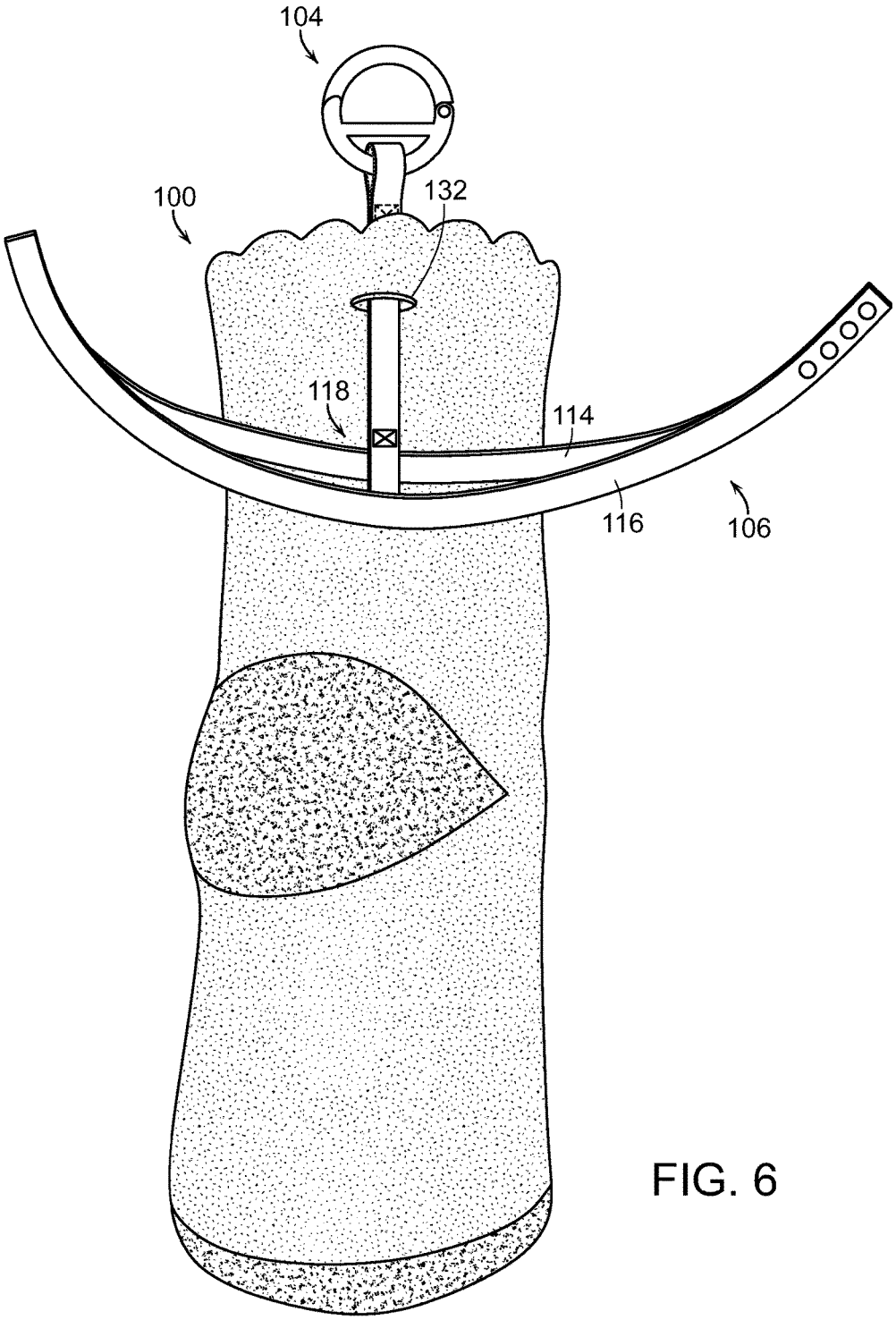
FIG. 6 is a back perspective view of the first covering with the second connector passing through the first connector.

Referring to FIG. 6, the second connector 106 is shown in more detail from the rear and generally comprises a first section 114 and a second section 116. The first section 114 is coupled to the second section 116 in such a manner as to allow a gap to remain therebetween for some length. This enables the second connector 106 to be rotatably adjustable about the first covering 100. The first section 114 is coupled to the second section 116 along at least two points. The coupling at these points may be permanent or removable. If the coupling is removable, the first section 114 or second section 116 can be passed through the second channel 118 of the first connector 102 to join the two components. The second channel 118 is formed between the two connection points (see FIG. 4A) on the first covering, however, the second connector 106 partially obscures one of the points in this particular view. Alternatively, and preferably, the first section 114 and the second section 116 are permanently joined and sold with the first covering 100 as a single "unit." The permanent configuration operates in the same manner as described above with regard to the removable configuration. Such a single unit (permanent) composition ensures no part is lost as well as promotes safety for the child by removing any choking hazard. The connector 104 can then passed through the aperture 132 as shown in FIG. 6.

Figure 7A:
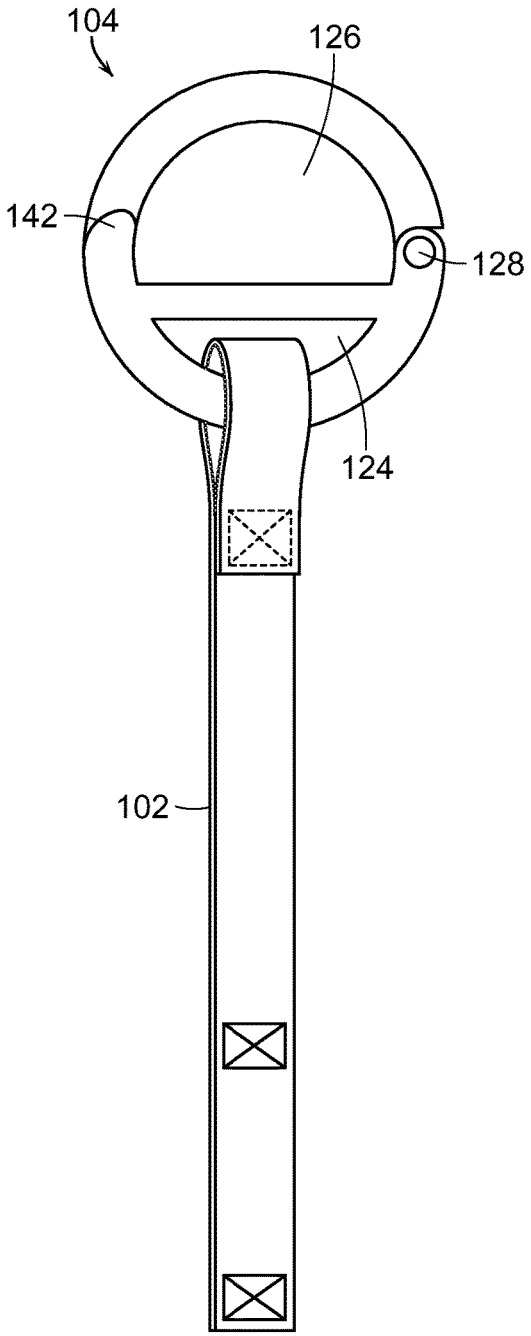
FIG. 7A is a first embodiment of the connector.
Figure 7B:
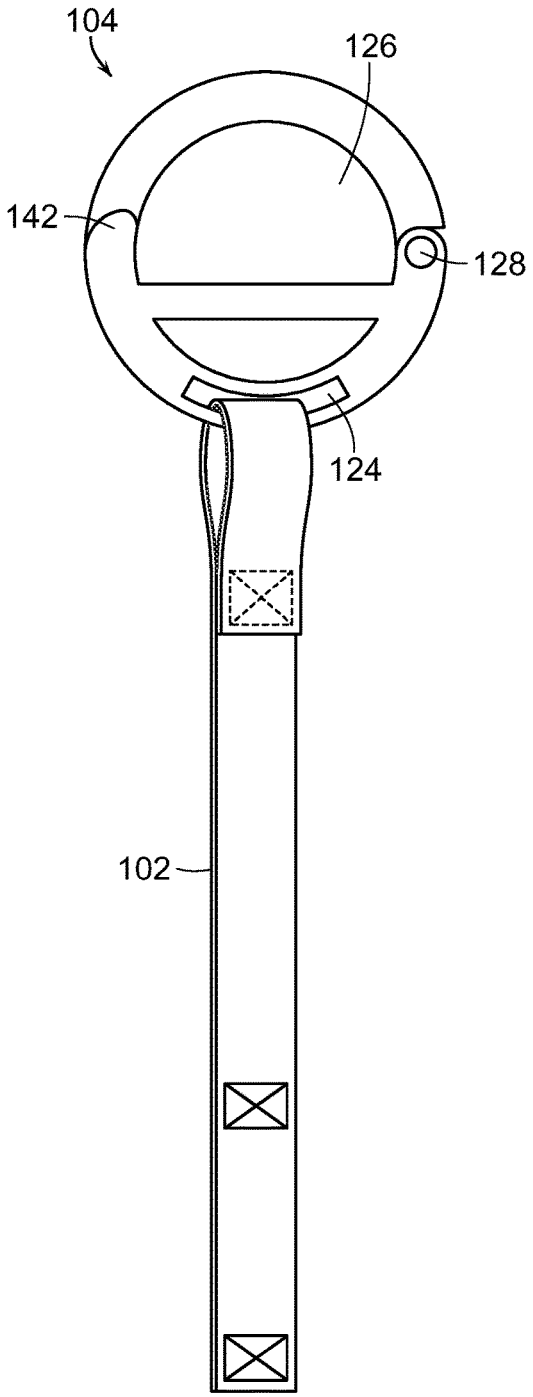
FIG. 7B is a second embodiment of the connector.

In FIGS. 7A and 7B, two alternative embodiments of the connector 104 are shown. While these two embodiments are shown, it should be noted that any number of embodiments of the connector 104 may exist and the two embodiments shown are exemplary only.

Each of the connectors 104 is shown being connected to a first connector 102. The first connector 102, as previously described, is preferably coupled to the first covering 100 as shown in at least FIG. 6. The connector 104 is generally comprised of a member, which may be circular or generally polygonal or non-polygonal, comprising a first section and a second section and having a hinge 128 and a securement mechanism 142. The hinge 128 may be any mechanism that is capable of causing movement of one of the first section or the second section with relation to the other section. In some instances, the hinge 128 allows for movement of both sections.

The securement mechanism 142 preferably enables the two sections of the connector 104 to be brought together and secured thereto. The securement mechanism 142 may provide for a locking element or may use a friction fit to removably secure the two sections to one another. A first coupling channel 124 and a second coupling channel 126 further are embodied by the connector 104.

In FIG. 7A, the first coupling channel 124 and the second coupling channel 126 both reside in the interior area of the connector 104. However, as shown in FIG. 7B, the second coupling channel 126 comprises the interior of the connector 104 and the first coupling channel 124 resides within one of the first section or second section of the connector 104. In either instance, the location, orientation, and the like may vary with respect to the actual configuration.

Figure 8:
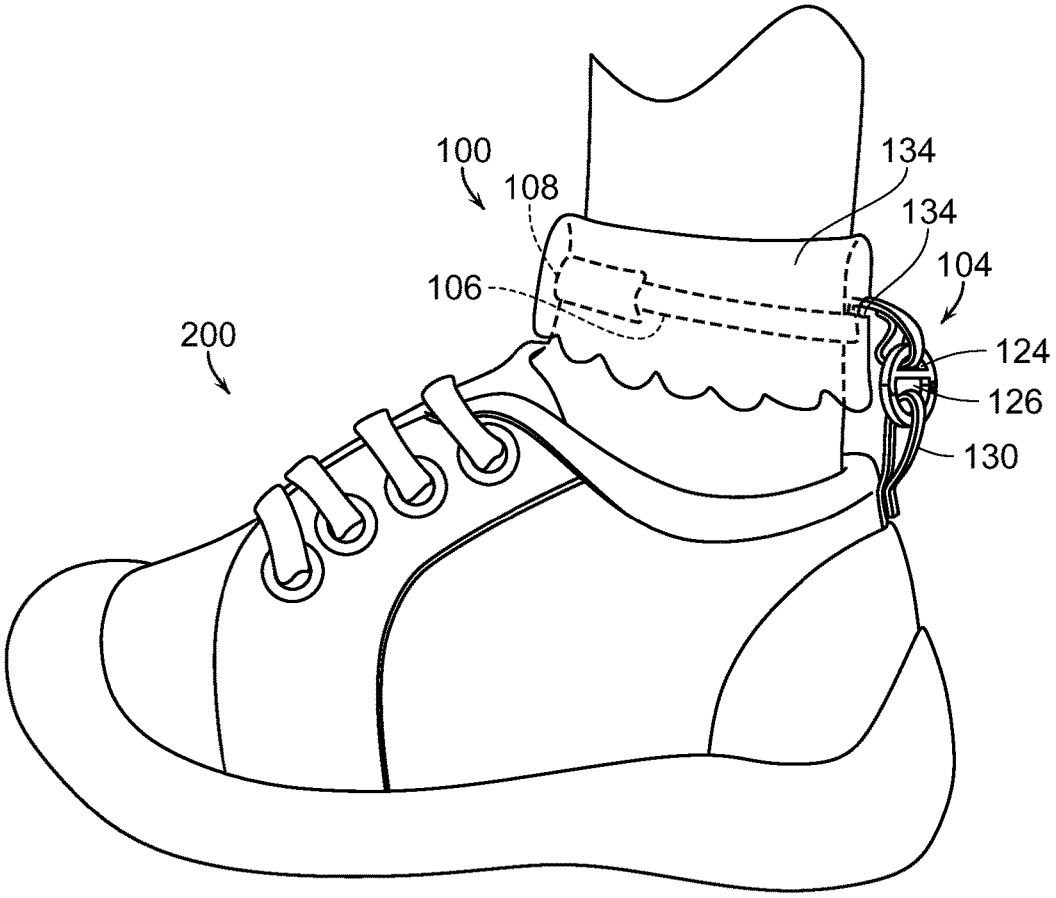
FIG. 8 is a side view of the first covering coupled to the second covering.
Figure 9:
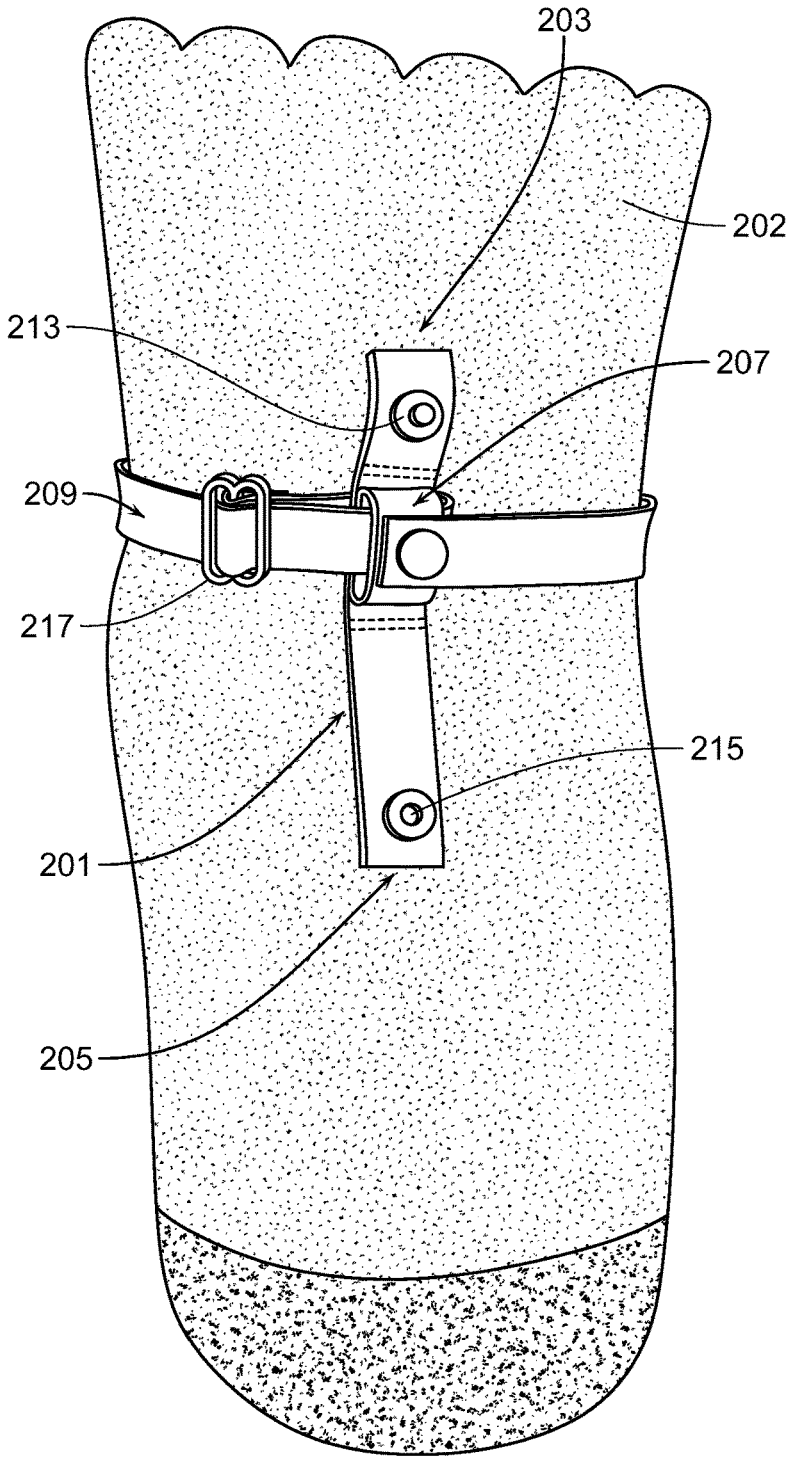
FIG. 9 is a perspective view of a second embodiment of the present invention with the strap system of the second embodiment exposed.
Figure 10:
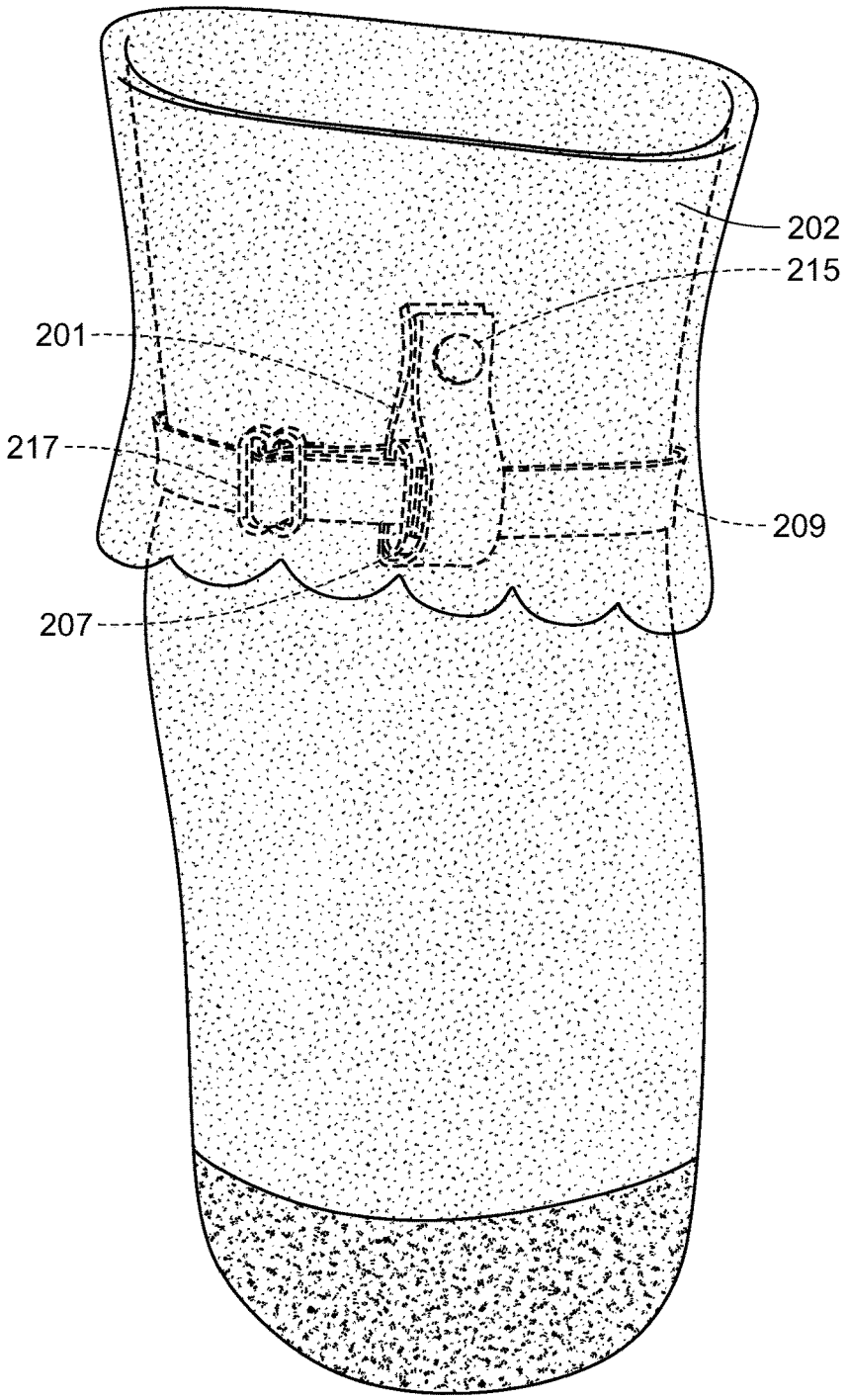
FIG. 10 is a perspective front view of the second embodiment with the sock at least partially covering the strap system of the second embodiment.
Figure 11:
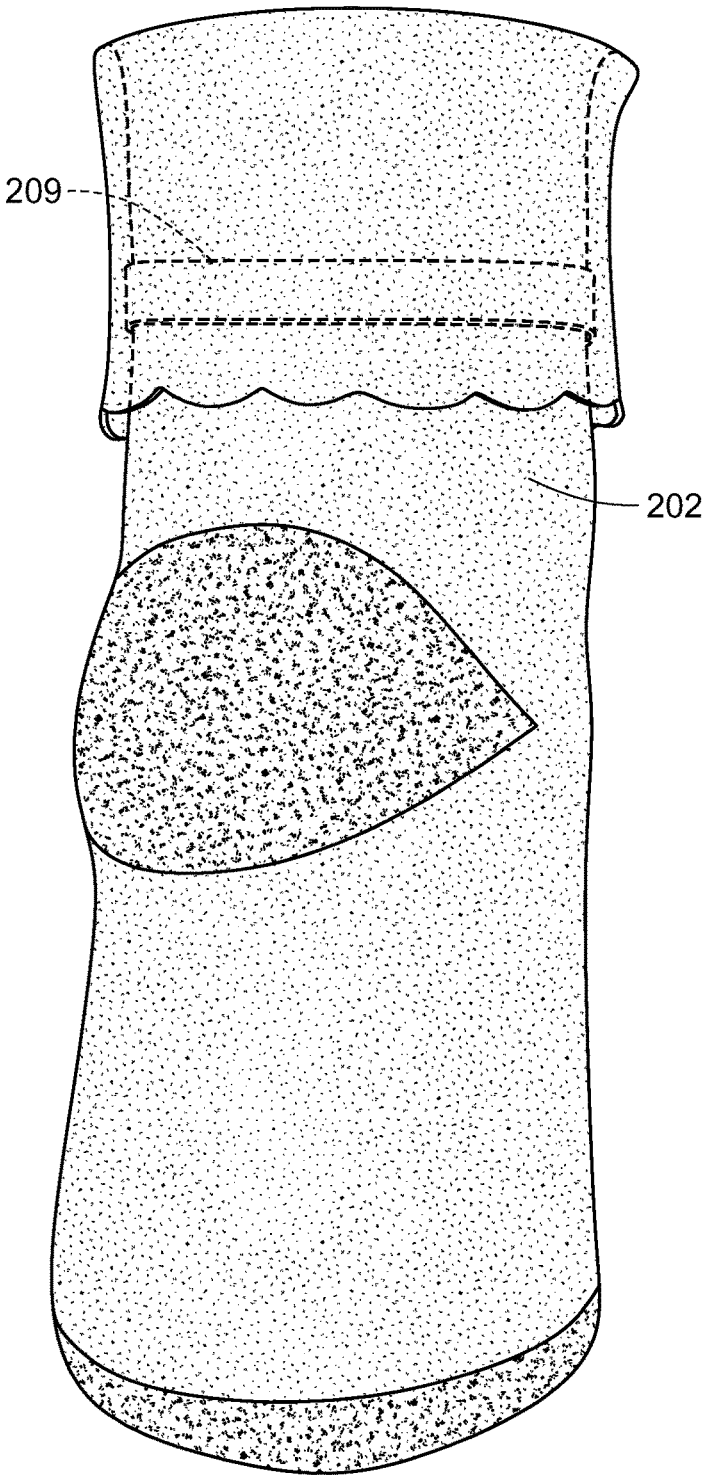
FIG. 11 is a back view of the second embodiment with the sock at least partially covering the strap system of the second embodiment.
Figure 12:
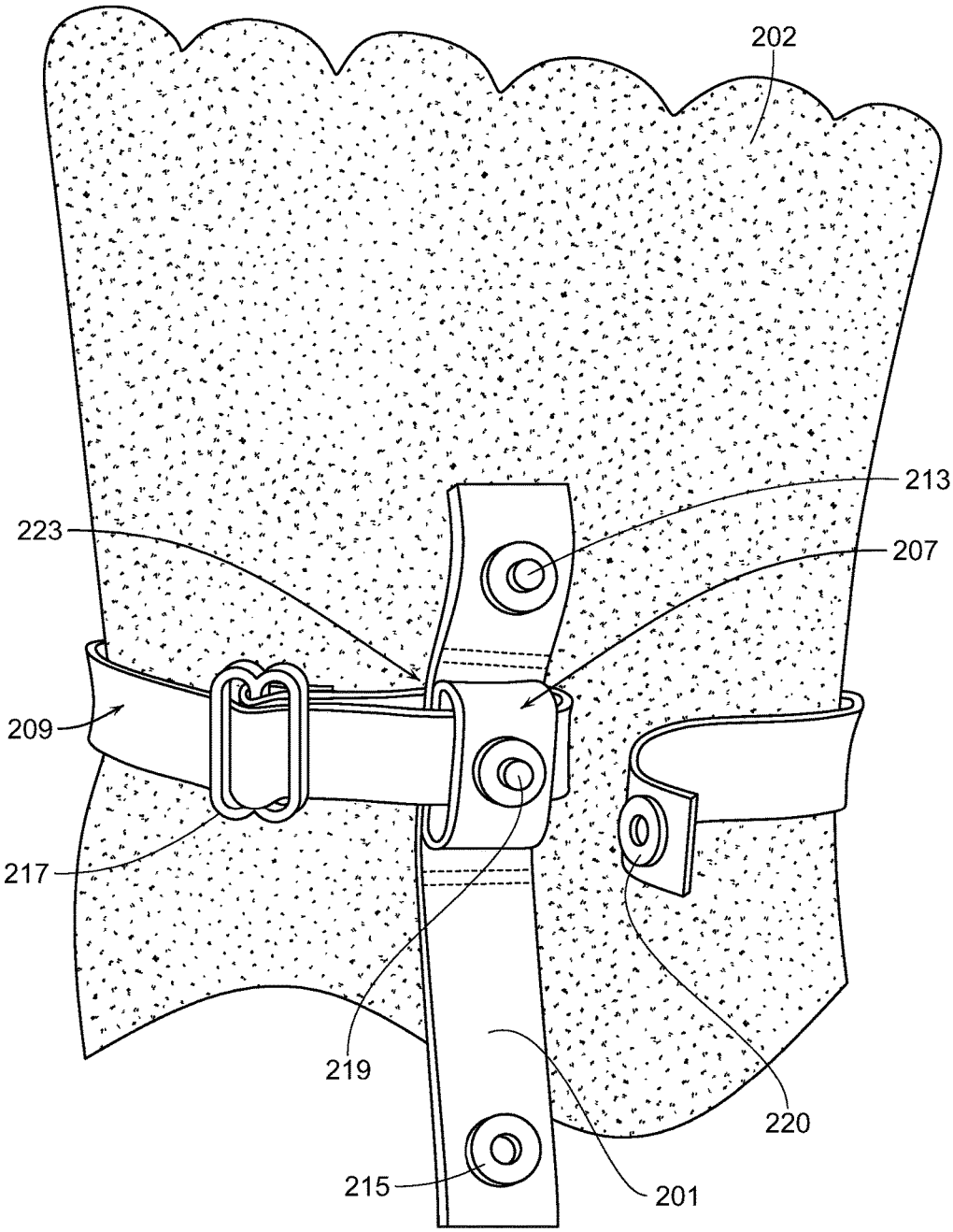
FIG. 12 is an enlarged front perspective view of the strap system of the second embodiment in an open configuration.
Figure 13:
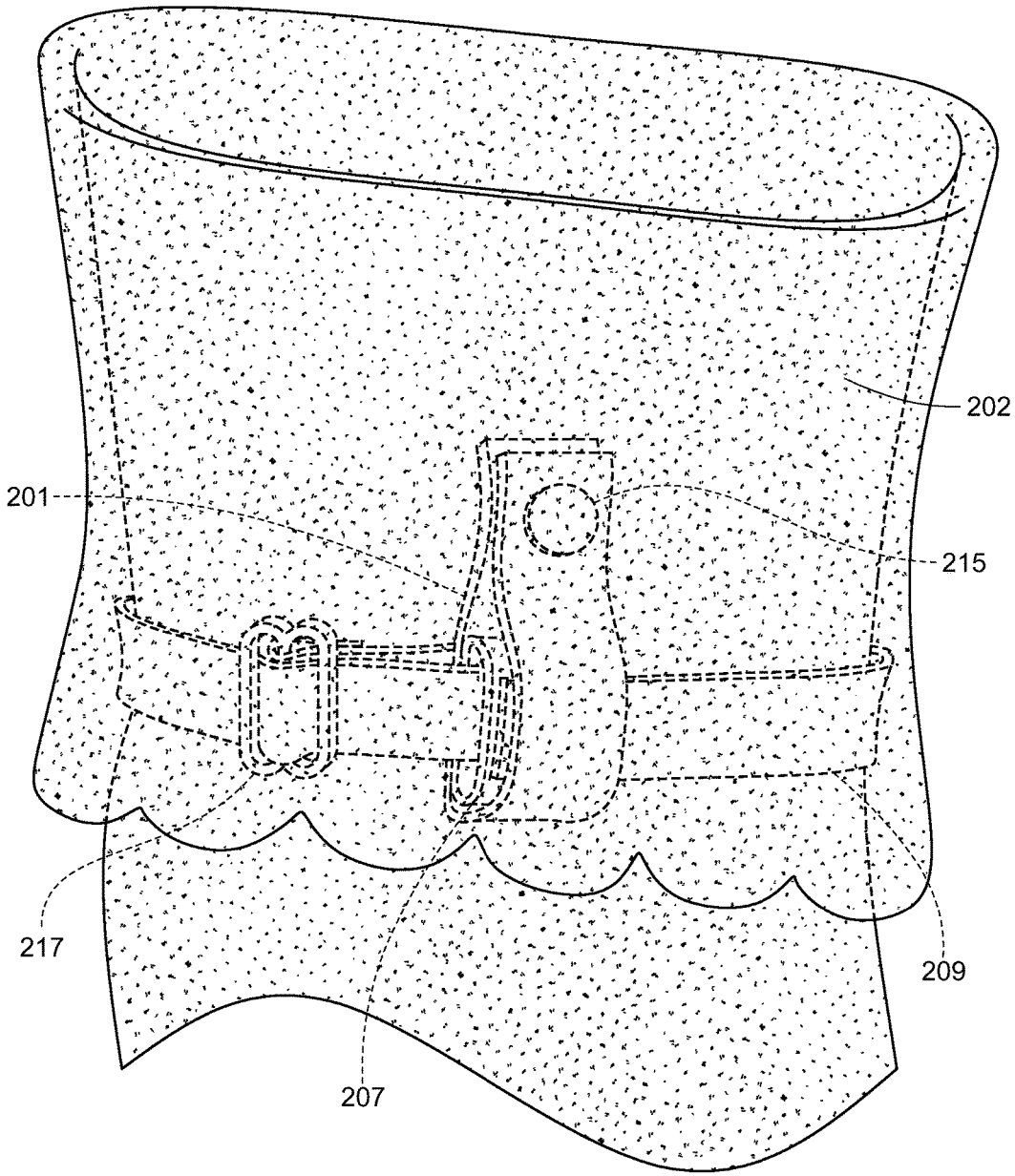
FIG. 13 is an enlarged front perspective view of the strap system fully secured and the sock at least partially covering the strap system of the second embodiment.
Figure 14:
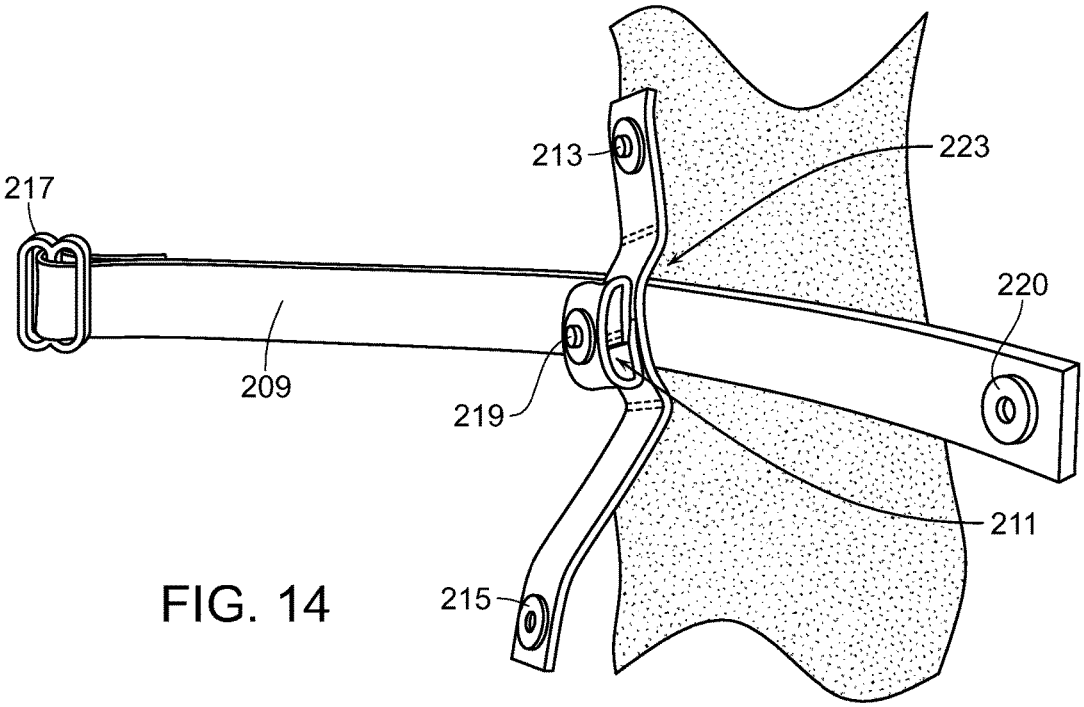
FIG. 14 is a side view of the second embodiment with the third strap passing through at least one channel.
Figure 15:
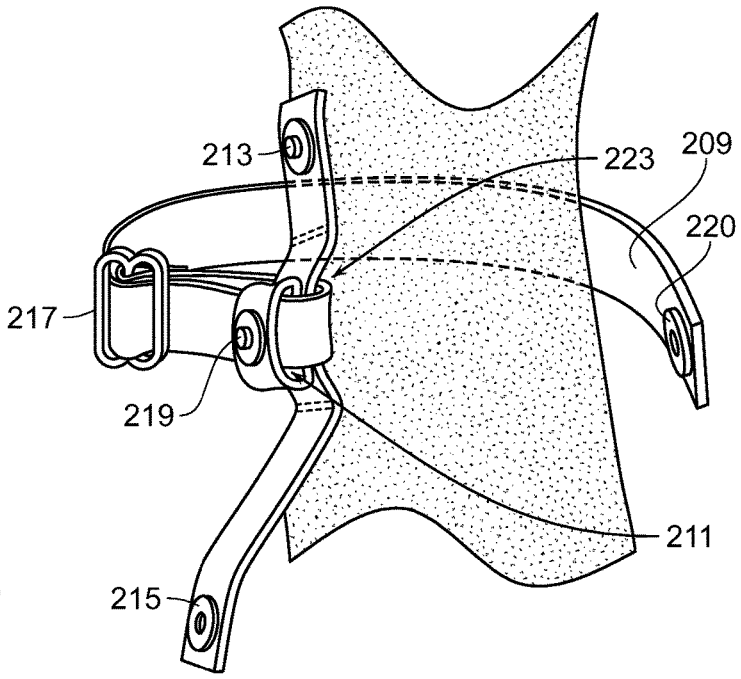
FIG. 15 is a side perspective view of the second embodiment with the third strap passing through at least two channels.
Figure 16:
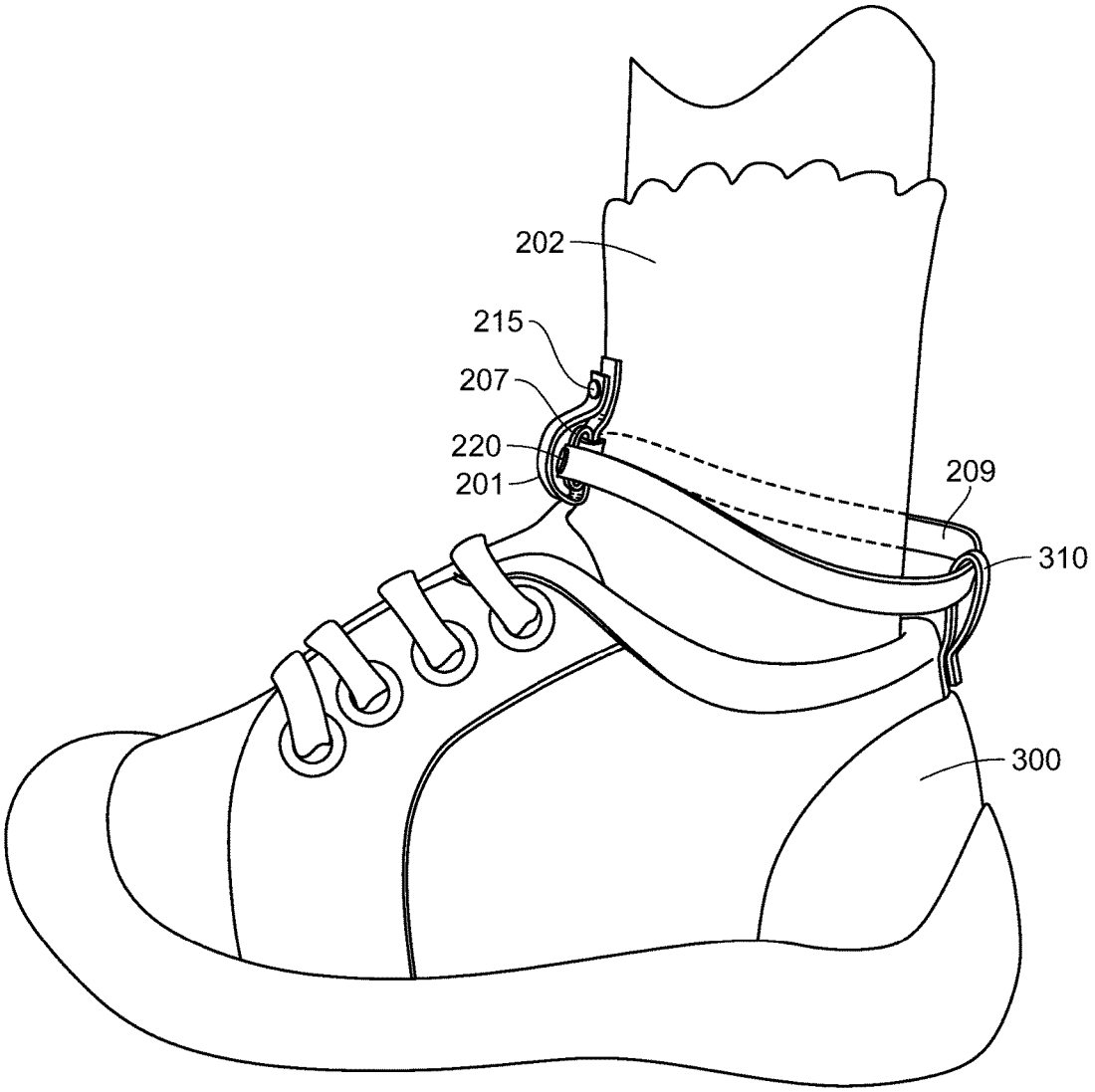
FIG. 16 is a side view of the second embodiment coupled to a sock and an article of footwear.

FIG. 8 shows an embodiment of an arrangement between a first covering 100 and a second covering 200. The first covering 100 has been positioned as intended with the top area 134 folded down covering the second connector 106 and the first channel 108. The first connector 104 is passing through the aperture 132 and, via the second coupling channel 126, is coupled to the second covering 200. The second covering 200 may have a coupling channel 130 or other suitable connection mechanism. Here, for example, the coupling channel 130 is a loop. However, other mechanisms including cuffs, snaps, buttons, apertures, and the like may be used.

The present invention and its embodiments described in FIGS. 1-8 is preferably used to prevent the removal of an article of footwear and a covering for the bodily appendage from a young child. In use, the first covering is placed and positioned on the child's hand, head, foot, or other bodily appendage. The first covering preferably has a first connector and a connector coupled thereto.

The first covering may be secured to the appendage by way of the second connector. The second connector has coupling mechanism(s) and complimentary coupling mechanism(s) that allow for selectively adjusting the "tightness" or "looseness" of the first covering around the appendage. In turn, this can help to prevent removal of the first covering from the appendage. The second connector may then be covered by a portion of the first covering with a first connector pulled through an aperture therein. This may restrict access to the second connector and add an additional layer of dexterity to remove the apparatus and system as a whole.

The first connector, being pulled through the aperture in the first covering, is now available to interact with the second covering. The second covering may then be positioned near or in a proximity to the first covering. In some instances, the second covering is positioned on the body before the first covering. In other instances, the second covering does not reside on or is not fully on the body yet remains coupled to the first covering.

The second covering can then be coupled to the first covering by way of a coupling channel or similarly situated structure. In at least one embodiment, the connector is coupled to a loop present on the second covering. In some instances, this is the loop on the back of a shoe or other article of footwear. The connector should be removably coupled in such a way that prevents unintentional uncoupling of the connector to the coupling channel of the second covering.

Further, the first covering and the second covering should be positioned such that the second covering cannot be removed when coupled to the first covering. In one potential embodiment, there is an article of footwear coupled to a sock. The sock is further coupled to the foot by way of the second connector, as well as the sock's natural form fitting qualities. When the shoe is attempted to be removed while coupled to the sock, the first connector is prevented from being pulled past the second connector. This length prevents the shoe from being brought past the bottom of the heel. Thus, the shoe cannot be removed while coupled to the sock.

Referring now to FIGS. 9-16, there is a second embodiment of the present invention. Generally, the second embodiment comprises a first strap 201, second strap 207, and third strap 209. The first strap 201 has a first end 203 and a second end 205 with a first connector 213 on the first end 203 and a second connector 215 on the second end 205. The first strap 201 is coupled to the sock 202 forming a channel 223 between the sock 202 and the first strap 201. The second strap 207 is coupled to the first strap 201 thereby forming a channel 211. An outer surface of the second strap 207 is directly affixed to an outer surface of the first strap 201. The second strap 207 may be coupled or otherwise affixed to the first strap 201 via threading, fasteners, snaps, and the like or some combination thereof. The second strap 207 has a first end and a second end affixed to one another forming a loop structure. This loop structure forms the channel 211. A connector 219 is disposed on an outer surface of the second strap 207 on an opposite side of the second strap 207 from which that is coupled to the first strap 201.

The third strap 209 preferably has a looped end and a tail end. The looped end is formed in part by the length adjustment mechanism 217 which allows the third strap 209 to pass through the length adjustment mechanism twice thereby forming a loop on one side of the length adjustment mechanism 217 and a tail on the other side of the length adjustment mechanism 217. The loop is formed by passing the third strap 209 through channel 211 and channel 223 thereby securing the loop to the first strap 201 and the second strap 207. This allows the tail end of the third strap 209 to be pulled around the ankle of the user and secured to the connector 219 positioned on the second strap 207.

The first strap 201, second strap 207, and third strap 209 may be made of the same or a different material. Exemplary materials may include but are not limited to woven or unwoven fabric, cloth, terrycloth, woven or woven fibers of wool, flax, cotton, and/or yarn, denim, elastomeric fibers/fabrics, and synthetic textiles including but not limited to nylon, polyester, and/or acrylic, or any combinations thereof.

The connectors 213, 215, 219, and 220 may be comprised of various combinations of male/female connectors having a particular interference to allow secure coupling of the connectors while allowing for release of the connector when desired. Preferably, there is one male connector and one female connector on the first strap 201, a male or female connector on the second strap 207, and a male or female connector on the third strap 209. The aforementioned connector arrangement is made with the caveat the connector chosen for the second strap 207 and the third strap 209 are to be opposite of one another allowing them to be coupled as described below.

In use, the second embodiment is affixed to a child or other user by providing a sock 202 having the first strap 201 coupled thereto. The looped end of the third strap 209 is passes through both channel 211 formed by the second strap 207 and channel 223 formed by sock 202 and the first strap 201. The length of the third strap 209 may be adjusted via a length adjustment mechanism 217. The length adjustment mechanism 217 allows for the looped portion and the tail portion of the third strap 209 to be modified to provide a desired fit as needed.

The third strap 209, once size adjusted, is passed through a looped portion 310 of an article of footwear 300. The third strap 209 is maneuvered to the front of the user and the connector 220 on the third strap 209 is coupled to the connector 219 on the second strap 207. This forms a gentle but firm enclosure around an ankle of the child or other user. The connector 215 on the second end 205 of the first strap 201 is folded upwards to meet the connector 213 on the first end of the first strap 201. This is achieved since the first strap 201 is affixed to the sock 202 at a first point and a second point with the first point being in proximity to the first end 203 and at approximately a midpoint of the first strap 201. This process securely positions the third strap 209 and, since covered by the first strap 201, prevents the third strap 209 from becoming undone.

Additionally, a user may fold the sock 202 down over at least a portion of the first strap 201, second strap 207, and the third strap 209. The sock 202 may be folded down a singular time to cover the strap system of the embodiments of the present invention. In other embodiments, the sock 202 is folded at least one time before it is folded down subsequently to cover the strap system of the embodiments of the present invention. This folding of the sock 202 may provide comfort to the wearer as well as provide an additional layer of security from the embodiment becoming undone unexpectedly. Further, the folding of the sock 202 will conceal snaps and prevent any injury to the wearer or another third party.

Similar mechanisms can be used in order to, for example, couple a coat to a pair of mittens, whereby a child cannot removed the mittens while coupled to the coat, and the child is incapable of possessing the motor skills to remove the mittens. The overall invention is intended to comprise multiple interconnected components providing a safety component for the young child. Since parts cannot be removed from one another, any individual component cannot comprise a choking hazard. Other such embodiments exist and are contained under the purview of this invention.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An apparatus for preventing removal of an article of footwear, the apparatus comprising:

a sock having a first strap coupled thereto, the first strap having a first end and a second end, wherein the first end has a first connector disposed thereon and the second end has a second connector disposed thereon;

a second strap coupled to the first strap, the second strap being configured to form at least one channel;

a third strap configured to pass through the at least one channel, wherein the third strap has a third connector disposed thereon; and a fourth connector disposed on an outer surface of the at least one channel formed by the second strap.

2. The apparatus of claim 1 wherein a length of the third strap is adjustable.

3. The apparatus of claim 1 further comprising a length adjustment mechanism coupled to the third strap.

4. The apparatus of claim 3 wherein the third strap passes through the size adjustment mechanism forming a loop and a tail.

5. The apparatus of claim 4 wherein the third connector is disposed on a distal end of the tail.

6. The apparatus of claim 1 wherein the second strap is directly affixed to the first strap.

7. The apparatus of claim 1 wherein the first strap is coupled to the sock at a first connection point and a second connection point.

8. The apparatus of claim 7 wherein the first connection point is at about first end of the first strap and the second connection point is at about a midpoint of the first strap.

9. An apparatus for preventing removal of an article of footwear, the apparatus comprising:

a sock having a first strap coupled thereto, the first strap having a first end and a second end, wherein the first end has a male connector disposed thereon and the second end has a female connector disposed thereon;

a second strap directly affixed to the first strap, the second strap being configured to form at least one channel and having a male connector disposed thereon;

a third strap configured to pass through the at least one channel, wherein the third strap has a female connector disposed on a first end of the third strap, and wherein a length of the third strap is adjustable; and a fourth connector disposed on an outer surface of the at least one channel formed by the second strap.

10. A method of securing of an article of footwear, the method comprising the steps of:

providing a sock comprising:

a first strap coupled thereto, the first strap having a first end and a second end, wherein the first end has a first connector disposed thereon and the second end has a second connector disposed thereon;

a second strap coupled to the first strap, the second strap being configured to form at least one channel; and a third strap configured to pass through the at least one channel, wherein the third strap has a third connector disposed thereon;

wrapping the third strap around a circumference of the sock, wherein the third strap passes through a channel of the article of footwear;

coupling the third connector to a fourth connector disposed on the second strap;

coupling the second connector of the first strap to the first connector of the first strap.

11. The method of claim 10 further comprising the step of: adjusting a length of the third strap.

12. The method of claim 10 further comprising the step of: folding the sock down over at least a portion of the first strap, second strap, and the third strap.

* * * * *